US010907258B1

(12) United States Patent
Kota

(10) Patent No.: US 10,907,258 B1
(45) Date of Patent: Feb. 2, 2021

(54) SURFACE MODIFICATION OF METALS AND ALLOYS TO ALTER WETTING PROPERTIES

(71) Applicant: Arrowhead Center, Inc., Las Cruces, NM (US)

(72) Inventor: Krishna Kota, Las Cruces, NM (US)

(73) Assignee: Arrowhead Center, Inc., Las Cruces, NM (US)

( * ) Notice: Subject to any disclaimer, the term of this patent is extended or adjusted under 35 U.S.C. 154(b) by 283 days.

(21) Appl. No.: 15/687,365

(22) Filed: Aug. 25, 2017

Related U.S. Application Data

(60) Provisional application No. 62/379,702, filed on Aug. 25, 2016.

(51) Int. Cl.

| | |
|---|---|
| ***C23F 1/14*** | (2006.01) |
| ***B05D 1/18*** | (2006.01) |
| ***B24D 11/00*** | (2006.01) |
| ***B05D 7/14*** | (2006.01) |
| ***B05D 3/02*** | (2006.01) |

(52) U.S. Cl.
CPC ..... *C23F 1/14* (2013.01); *B05D 1/18* (2013.01); *B05D 3/0272* (2013.01); *B05D 7/14* (2013.01); *B24D 11/00* (2013.01)

(58) Field of Classification Search
None
See application file for complete search history.

(56) References Cited

U.S. PATENT DOCUMENTS

| | | | |
|---|---|---|---|
| 8,580,134 | B2 | 11/2013 | Tong et al. |
| 8,691,104 | B2 | 4/2014 | Greer et al. |
| 2009/0176018 | A1 | 7/2009 | Zou et al. |
| 2010/0268346 | A1 | 10/2010 | Tong et al. |
| 2012/0181346 | A1 | 7/2012 | Greer et al. |

(Continued)

FOREIGN PATENT DOCUMENTS

| | | |
|---|---|---|
| CN | 105803447 | 7/2016 |
| CN | 106381492 | 2/2017 |

(Continued)

OTHER PUBLICATIONS

Liu et al.; A novel combination approach for the preparation of superhydrophobic surface on copper and consequent corrosion resistance; (2016), Corrosion Science, 110, pp. 105-113. (Year: 2016).*

(Continued)

*Primary Examiner* — David Sample
*Assistant Examiner* — Elizabeth Collister
(74) *Attorney, Agent, or Firm* — Peacock Law P.C.; Philip D. Askenazy; Deborah A. Peacock

(57) ABSTRACT

Surfaces of metals and alloys that exhibit hydrophilic, omniphilic or hydrophobic properties, and methods of preparation thereof. The surface is roughened by surface polishing, thermo-catalytic etching, and temperature gradient etching. This procedure produces a hierarchical micro-/nano-scale roughness in the surface which comprises grooves, micro-cavities, and nano-cavities. This greatly enhances the hydrophilic and omniphilic properties of the pure surface without the need for coatings or oxidation. A further step of immersing the roughened surface in a stearic acid solution makes the surface hydrophobic or superhydrophobic.

12 Claims, 10 Drawing Sheets

(56) References Cited

U.S. PATENT DOCUMENTS

| | | | | |
|---|---|---|---|---|
| 2012/0328905 | A1* | 12/2012 | Guo | C21D 8/0294 428/687 |
| 2014/0208978 | A1 | 7/2014 | Sunder et al. | |
| 2015/0175814 | A1 | 6/2015 | Aizenberg et al. | |
| 2016/0136336 | A1 | 5/2016 | Jennissen et al. | |
| 2016/0153094 | A1 | 6/2016 | Tuteja et al. | |
| 2017/0015835 | A1 | 1/2017 | Aizenberg et al. | |

FOREIGN PATENT DOCUMENTS

| | | |
|---|---|---|
| JP | 2015214072 | 12/2015 |
| KR | 1020110085106 | 7/2011 |
| TW | 201420815 | 6/2014 |

OTHER PUBLICATIONS

"3M Flourinert (TM) Electronic Liquid FC-770", Product Information, 2007.
"3M Performance Fluid PF-5060", Product Information, 2003.
"Nano-Coatings for Water Control", http://www.lotusleafcoatings.com [Downloaded Nov. 3, 2017].
Al-Janabi, A. , et al., "Environmentally Friendly Solvent- and Water-Based Coatings for Mitigation of Crystallization Fouling", Chemical Engineering & Technology, vol. 38, No. 1, 2015, 147-154.
Atefi, E. , et al., "A Robust Polynomial Fitting Approach for Contact Angle Measurements", Langmuir, vol. 29, No. 19, 2013, 5677-5688.
Beving, D. E., et al., "Hydrophilic and Antimicrobial Low-silica-zeolite LTA and High-silica-zeolite MFI Hybrid Coatings on Aluminum Alloys", Microporous and Mesoporous Materials, vol. 108, 2008, 77-85.
Bhushan, B. , et al., "Micro- Nano- and Hierarchical Structures for Superhydrophobicity, Self-cleaning and Low Adhesion", Philosophical Transaction of the Royal Society A, 2009, 1631-1672.
Bormashenko, E. , "Progress in Understanding Welling Transitions on Rough Surfaces", Advances in Colloid and Interface Science, vol. 222, Elsevier B.V., 2015, 92-103.
Chattopadhyay, A. K., et al., "Study of Wettability Test of Pure Aluminum against Uncoated and Coated Carbide Inserts", Surface and Coatings Technology, vol. 204, 2009, 410-417.
Clegg, Nicholas , et al., "Achieving Ultra-Omniphilic Wettability on Copper Using a Facile, Scalable, Tuned Bulk Micromanufacturing Approach", Journal of Micro- and Nano-Manufacturing, Sep. 2017, vol. 5, Sep. 2017, 031003-1-031003-7.
Ganesh, V. Anand, et al., "A review on self-cleaning coatings", Journal of Materials Chemistry, 21, Sep. 2, 2011, 16304-16322.
Ge, Z. B., et al., "Thermal Conductance of Hydrophilic and Hydrophobic Interfaces", Physical Review Letters, 2006, 18061-(1)-18061-(4).
Guo, Y. , et al., "General Route toward Patterning of Graphene Oxide by a Combination of Wettability Modulation and Spin-Coating", ACS Nano, vol. 4, No. 10, 2010, 5479-5754.
Harth, M. , et al., "Simple Approach for Spreading Dynamics of Polymeric Fluids", Macromolecular Chemistry and Physics, vol. 213, 2012, 654-665.
Hong, K. T., et al., "Wetting Coatings for Dehumidifying Heat Exchangers", Int. J. HVAC&R Research, vol. 6, 2000, 229-242.
Hu, H. , et al., "Effect of Nanopattems on Kapitza Resistance at a Water-gold Interface during Boiling: A Molecular Dynamics Study", Journal of Applied Physics, vol. 112, 2012, 053508-1-6.
Huang, D. , et al., "Fabrication of High Wettability Gradient on Copper Substrate", Applied Surface Science, vol. 280, 2013, 25-32.
Kotula, P. G., et al., "Automated Analysis of SEM X-Ray Spectral Images: A Powerful New Microanalysis Tool", Microscopy and Microanalysis, vol. 9, 2003, 1-17.
Liu, Kesong , et al., "Metallic Surfaces with special wettability", Nanoscale 3, Jan. 7, 2011, 825-838.
Mante, P. A., et al., "Probing Hydrophilic Interface of Solid/Liquid-Water by Nanoultrasonics", Scientific Reports, 4:6249, 2014.
Marmur, A. , "Wetting of Hydrophobic Rough Surfaces: To be heterogeneous or not to be?", Langmuir, vol. 19, No. 20, 2003, 8343-8348.
Min, Jingchun , et al., "Hydrophilic treatment and performance evaluation of copper finned tube evaporators", Applied Thermal Engineering, vol. 31, Elsevier Ltd., 2011, 2936-2942.
Mondal, B. , et al., "Design and Fabrication of a Hybrid Superhydrophobic-Hydrophilic Surface that Exhibits Stable Dropwise Condensation", ACS Applied Materials & Interfaces, vol. 7, 2015, 23575-23588.
Qian, B. , et al., "Fabrication of Superhydrophobic Surfaces by Dislocation-selective Chemical Etching on Aluminum, Copper, and Zinc Substrates", Langmuir, vol. 21, No. 20, 2005, 9007-9009.
Santos, L. , et al., "Micro/Nano-Structured Polypyrrole Surfaces on Oxidizable Metals as Smart Electroswitchable Coatings", ACS Applied Materials & Interfaces, vol. 5, No. 20, 2013, 10159-10164.
Seveno, D. , et al., "Dynamics of Wetting Revisited", Langmuir, vol. 25, No. 22, 2009, 13034-13044.
Tadanaga, K. , et al., "Superhydrophobic-superhydrophilic Micropatteming on Flowerlike Alumina Coatings Film by the Sol-gel Method", Chemistry of Materials, vol. 12, No. 3, 2000, 590-592.
Wankhede, R. G., et al., "Development of Water-repellent Organic-inorganic Hybrid Sol-gel Coatings on Aluminum Using Short Chain Perfluoro Polymer Emulsion", Applied Surface Science, vol. 283, 2013, 1051-1099.
Wenzel, R. , "Resistance of Solid Surfaces to Wetting by Water", Industrial and Engineering Chemistry, vol. 28, 1936, 988-994.
Yang, J. , et al., "Intermediate Wetting States on Nanoporous Structures of Anodic Aluminum Oxide Surfaces", Thin Solid Films, vol. 562, 2014, 353-360.
Zhang, L. , et al., "Fabrication and Application of Superhydrophilic Surfaces: A Review", Journal of Adhesion Science and Technology, vol. 28, 2012, 769-790.
Zhao, Q. , et al., "Graded NI-P-PTFE coatings and their potential applications", Surface and Coatings Technology, vol. 155, 2002, 279-284.
Zhu, D. , "Electrically Conductive PEDOT Coating with Self-Healing Superhydrophobicity", Langmuir vol. 30, No. 16, 2014, 4671-4677.
Min, J., et al., Hydrophilic Treatments of Copper Fin Material, Proceedings of the 22nd International Congress of Refrigeration, Beijing, Aug. 21-27, 2007 [Abstract Only].

* cited by examiner

SURFACE MODIFICATION OF METALS AND ALLOYS TO ALTER WETTING PROPERTIES

CROSS-REFERENCE TO RELATED APPLICATIONS

This application claims priority to and the benefit of the filing of U.S. Provisional Patent Ser. No. 62/379,702, filed Aug. 25, 2016, entitled "Surface Modification of Metals and Alloys to Alter Wetting Properties", and the specification and claims thereof are incorporated herein by reference.

FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. 1449621 awarded by the National Science Foundation.

BACKGROUND OF THE INVENTION

Field of the Invention (Technical Field)

The present invention is related to etching of metal surfaces to modify their surface topology at micro- and nano-length scales, thereby altering their wetting properties.

Background Art

Note that the following discussion refers to a number of publications and references. Discussion of such publications herein is given for more complete background of the scientific principles and is not to be construed as an admission that such publications are prior art for patentability determination purposes.

Copper has numerous practical and industrial applications such as thermal and fluid transport, and altering the wetting characteristics of copper may positively impact numerous practical applications. Finely polished copper typically has a contact angle (CA) between 70° and 80° for water droplets, and the value changes for different liquids. Improving the wetting characteristics of copper, with its excellent heat conducting properties, with durable, non-toxic hydrophilic (or even better, omniphilic i.e., wettability to almost all liquids) or hydrophobic surface treatments will positively and significantly impacts numerous applications in thermal management, energy, water, automotive, nuclear, electrical, electronics, air-conditioning, machining and electronics packaging industries among many others. Omniphilic copper with extreme wetting characteristics for most liquids has a variety of applications involving enhanced phase change heat transfer, for example in boiling and wicking surfaces in heat pipes, vapor chambers, heat exchangers including micro-channels and thermal spreaders. Alternatively, hydrophobic copper surfaces, could be very useful as anticorrosion, anti-bio fouling, or drag reduction and anti-icing surfaces.

It is known that both -philicity and -phobicity of a surface are functions of its roughness and the surface tension of the liquid. Increasing the roughness and the exposed surface area makes the hydrophilic behavior of a naturally wetting material more pronounced by increasing the contact area, i.e., the useful heat transfer area between liquids and copper. A typical example of this approach is found in industrial heat exchangers. Roughness is typically increased at micro- and/or nanoscales by surface patterning using clean room techniques, by depositing naturally hydrophilic coatings and/or particles, by etching techniques, or by employing innovative assembly approaches. Microfabrication, which can provide an extremely precise control over the roughness features, is relatively expensive and not conducive to implementation on large surface areas. Hydrophilic surfaces of metals have been generated by etching to generate nanostructures and sintering. Hydrophilic coatings have also been pursued for rendering wetting characteristics to copper surfaces. However, the contact angle (CA) of water droplets obtained using most of the current hydrophilic treatments on pure copper surfaces was only as low as 25-30°. With some techniques, such as using surface oxide formation, surface protrusion formation, hydrophilic coatings or sintering of particles on the surface, the CA was found to be less than 10°, but the durability, chemical compatibility, operating temperature range, poor heat transfer properties, poor abrasion characteristics, and poor adhesion of coatings, which also form a barrier to efficient heat transfer from the substrate to the bulk liquid in heat transfer applications, are detrimental to practical use.

SUMMARY OF THE INVENTION (DISCLOSURE OF THE INVENTION)

The present invention is a hydrophilic surface of a metal or alloy, the surface comprising a plurality of grooves, a plurality of micro-cavities, and a plurality of nano-cavities. The surface preferably does not comprise protrusions, a coating, or an oxide. The surface is preferably superhydrophilic, polyphilic, omniphilic or ultra-omniphilic and preferably has the same composition as the bulk metal or alloy. The grooves preferably each comprise a width of between 1 micron and 1000 microns. The micro-cavities preferably comprise a diameter of between 1 micron and 500 microns. The nano-cavities preferably comprise a diameter of less than 1 micron. The surface preferably comprises a contact angle of zero.

The present invention is also a a hydrophobic surface of a metal or alloy, the surface comprising a plurality of grooves, a plurality of micro-cavities, a plurality of nano-cavities, and an adsorbed ester layer. The ester preferably comprises a stearate.

The present invention is also a method for roughening a surface of a metal or alloy, the method comprising polishing the surface, thermo-catalytically etching the surface, and temperature gradient etching the surface. The method preferably increases a property of the surface, the property selected from the group consisting of hydrophilicity, superhydrophilicity, polyphilicity, omniphilicity, and ultra-omniphilicity. The method preferably does not comprise depositing a coating on the surface or oxidizing the surface. The method preferably produces grooves, micro-cavities, and nano-cavities in the surface. Either etching step is preferably performed using an etching mixture comprising a catalyst, a diluent, and an etching reagent. The concentration of etching reagent is preferably sufficient to etch the surface but not enough to cause surface passivation. Both etching steps are preferably performed using the same etching mixture. The method is preferably not performed in a clean room. The polishing step preferably comprises mechanically polishing the surface using silicon carbide abrasive papers. The step of temperature gradient etching the surface preferably comprises exposing the surface to an etching mixture while continuously decreasing a temperature of the etching mixture. The method preferably further comprises immersing the surface in a solution of stearic acid and ethanol, the surface thereby adsorbing a layer of an ester, thereby making the surface hydrophobic or superhydrophobic.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating certain embodiments of the invention and are not to be construed as limiting the invention. In the drawings:

FIG. 6A has a magnification of 37000×, FIG. 6B has a magnification of 10000×, FIG. 6C has a magnification of 5000×, and FIG. 6D has a magnification of 2500×.

FIG. 7A was taken with a stereoscopic microscope at 10×; FIG. 7B was taken with a scanning electron microscope (SEM) at 500×; and FIG. 7C was taken with an SEM at 2500×. The inset shown in FIG. 7B is not from the exact location shown in FIG. 7A; the inset shown in FIG. 7C is approximately from the same location marked in FIG. 7B.

DETAILED DESCRIPTION OF EMBODIMENTS OF THE INVENTION

Figure 1:
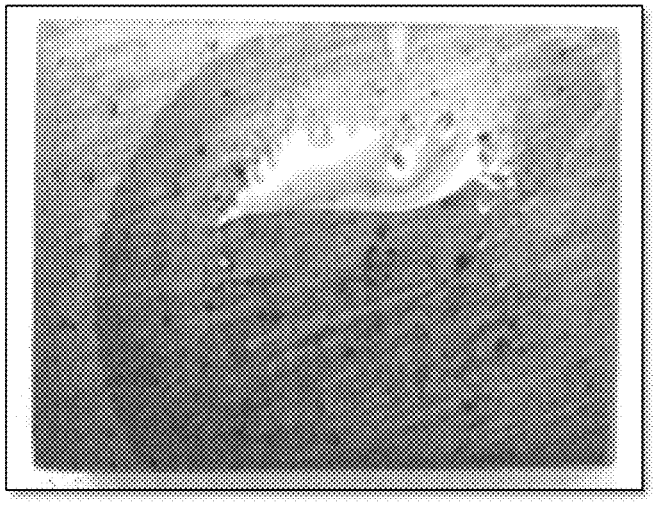
FIG. 1 is a photograph showing homogeneous wetting of a 5 mL water droplet on a locally super-saturated ultra-omniphilic copper surface. The contact angle is zero, implying that the interfacial energy between the solid and vapor phases ($\gamma_{SV}$), $\gamma_{SV}=\gamma_{SL}+\gamma_{LV}$, is balanced by the solid-liquid ($\gamma_{SL}$) and liquid-vapor ($\gamma_{LV}$) interfacial tensions.
Figure 2A:
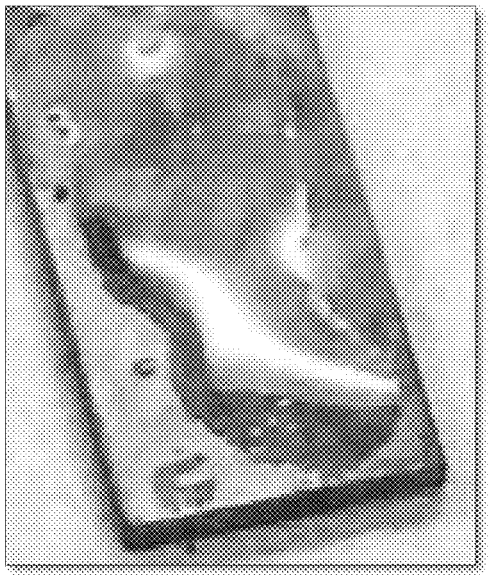
FIGS. 2A, 2B, 2C, and 2D are photographs showing extreme homogeneous wetting (i.e. the paper towel effect) on ultra-omniphilic copper surfaces for 5 mL droplets of FC-770®, water, glycerol, and mineral oil respectively.
Figure 2B:
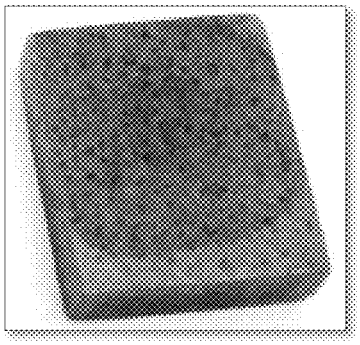
Figure 2C:
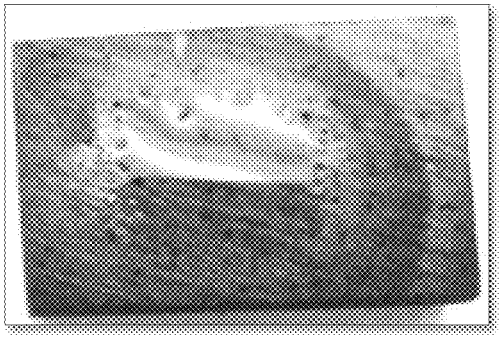
Figure 2D:
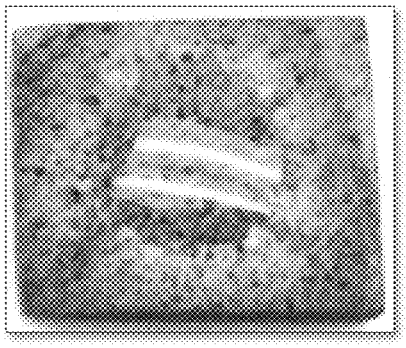

The present invention is a facile, low-cost, scalable approach to fabricating durable, non-toxic ultra-omniphilic and hydrophobic copper surfaces. The approach, based on controlled etching on artificially created metallurgical surface defects, can be realized on very large surfaces to generate robust ultra-omniphilic copper surfaces with liquid spreading behavior akin to a paper towel with CA of zero. The present invention utilizes tuning of the etching process to produce a surface with desired, multi-scale cavities (instead of protrusions) that increase roughness and improve wetting. The surface has substantially the same composition as the substrate material, unlike other technologies that rely on coatings or formation of different compounds on the surface.

In embodiments of the present invention, wetting characteristics of copper surfaces were significantly altered to be either ultra-omniphilic or super-hydrophobic using a facile, scalable surface treatment approach. This safe and cost-effective fabrication technique involving a simple three-step procedure consisting of mechanical polishing and controlled metallurgical etching resulted in generation of robust copper surfaces with either a contact angle of zero (with liquid spreading akin to a paper towel) without employing any coatings, sintering, electrochemical deposition or cleanroom fabrication techniques. Surface characterization showed that hierarchical micro-/nanoporous structure with embedded nano-cavities in the micro-cavities or embryos thereof was primarily responsible for the observed extreme homogeneous wetting characteristics. As with many other materials, increasing the roughness of copper was found to improve its wetting behavior to liquids. While wetting characteristics depend on surface roughness and surface tension of liquids in general, the modified copper surfaces were observed to exhibit remarkable wetting for numerous liquids similar to a paper towel suggesting that the wetting phenomenon is independent of surface tension of the liquid on these surfaces (as in the Wenzel model) and is only a function of surface roughness. It was also found that rough copper surfaces with an adsorbed hydrophobic monolayer exhibited robust super-hydrophobic characteristics (CA up to) 152°. The present invention has great potential to radically improve heat dissipation performance in devices such as microchannels and heat pipes, which often rely on efficient fluid flow and phase change on copper surfaces.

Embodiments of the omniphilic surface preparation approach of the present invention preferably comprise a three-step procedure (with an optional additional step for hydrophobic surface preparation) involving surface polishing followed by temperature dependent controlled metallurgical etching. In one embodiment, the present invention is a three-step process to produce a certain surface topology in metals and alloys, as shown for example in FIG. 6D. Step 1, preferably comprising surface polishing generates micro-grooves 10, which preferably connect cavities formed in subsequent steps, resulting in a rapid and massively parallel spreading/wetting on the surface. Surface polishing may comprise mechanical polishing, chemical polishing, pumped polishing (i.e. using a slurry), etc. The polishing step preferably maximizes existing surface defects and generates new artificial defects on the surface. These defects may comprise, for example, point defects, edge defects, line dislocations, or those due to the presence of impurities. The size of the micro-grooves is typically that of the abrasive used in this step, typically between one micron and 1000 microns.

Step 2, preferably comprising thermo-catalytic etching, generates nano-cavities 20, typically less than one micron in size, which provide an additional capillary wicking effect and improve the liquid holding capability of the surface. Step 3, preferably comprising temperature gradation etching, generates micro-cavities 30, preferably by expanding the nano-cavities obtained in Step 2; these micro-cavities provide the primary capillary wicking effect. The specific surface topology shown in the SEM images herein results in a very rapid spreading for many liquids, implying the spreading ability on these surfaces is independent of the liquid type and is only a function of the surface roughness features (hence, the paper towel effect). Visual examination of the roughened surfaces revealed that hierarchical micro- and nano-cavities, including nano-cavities 40 within or inside micro-cavities 30, was primarily responsible for the observed ultra-omniphilic behavior akin to a paper towel (CA of zero for multiple liquids). With an adsorbed coating of ester, the same ultra-omniphilic copper surfaces were found to exhibit robust super-hydrophobicity (CA 152° for water). Previously, it was not possible to produce a ultra-omniphilic or hydrophobic surface with hierarchical micro-/nano-scale roughness by directly using any known etching reagents. Typically the microcavities range in size from about 1 micron to 100 microns, but they can be as large as 500 microns.

The physics-backed tuning of the approach of embodiments of the present invention results in a surface with specific desirable roughness features for promoting wetting. Micro- and nano-cavities hold liquids onto the surface through very strong capillary forces, while micro-grooves enable rapid spreading of the liquids on the surface through capillary forces. The extreme wetting ability is applicable to multiple liquids (i.e. ultra-omniphilicity), preferably due to interconnected sub-surface micro- and nano-roughness architecture, including nano-cavities within the micro-cavities, connected by a network of micro-grooves. Although in some embodiments the sequence of polishing and etching steps may be different, in the above embodiment the sequence of steps is important to creating the desired surface structure. For example, if Step 1 is carried out after Steps 2 and 3, the free metal particles created by polishing would block at least some or most of the cavities, reducing omniphilicity. If Step 3 is implemented before Step 2, or if Step 2 is skipped, few if any micro-cavities would form, since the nano-cavities, which act as a nucleus to form micro-cavities, have to be formed first. If Step 3 is skipped, it will be very difficult to form micro-cavities using Step 2 alone, since very strong etching solutions are typically used to directly form micro-cavities, but such strong etching solutions frequently cause surface passivation, corrosion, and/or oxidation, which makes the surface non-reactive to further etching and/or decreases the sample surface purity.

A similar three-step procedure can be used for altering the wetting properties of metals and alloys in general other than copper. Depending on the type of the metal, only the composition of the etching reagent in Step 2 is preferably changed. For example, for making ultra-omniphilic aluminum, a mixture of methanol:water:nitricacid (as catalyst:diluent:etchingreagent) is preferably used as the etching solution instead of ethanol:water:hydrogen peroxide used for copper. The concentrations of the chemicals in Step 2 can be varied; i.e., the ratio of the components in the etching solution can be 3:3:1, 2:3:1, 2:2:1, 1:1:4 etc. depending on the condition of the original sample. The ratio is preferably any combination in the range (1-5):(1-5):(1-5). The concentration of the etching reagent itself is preferably such that the etching solution is sufficiently powerful (or potent) to etch the metal or the alloy surface but not so powerful as to cause surface passivation (which makes the surface non-reactive). Table 1 shows some example chemical combinations for various metals and alloys.

TABLE 1

| Metal | (1-5):(1-5):(1-5) ratios Catalyst:Diluent:Etching Reagent |
|---|---|
| Copper | Ethanol:Water:Hydrogen Peroxide |
| Aluminum, Lead and Lead Alloys | Methanol:Water:Nitric Acid |
| Brass | Ammonium Persulfate:Water:Ferric Chloride |
| Silver | Ammonium Hydroxide:Water:Hydrogen Peroxide |
| Tin | Hydrogen Fluoride:Water:Hydrochloric Acid |
| Stainless steel | Hydrogen Fluoride:Water:Nitric Acid |

Advantages of the present invention include low cost, rapid processing, scalability (can be produced on large or small surfaces in a same time frame, which is not possible with surfaces prepared in a clean room), highly robust surfaces that are resistant to mechanical and fluidic pressures (which is not possible with coated surfaces and surfaces prepared in a clean room), no barrier to heat transfer in thermal applications (unlike coatings), no contamination to liquids flowing over the metal surface (unlike coatings), can be produced on internal and/or curved surfaces without opening the device (e.g. inside pipes), and no release of harmful chemical gases during implementation of the approach in many cases as well as during the application.

EXAMPLE

Step 1: Polishing

Copper samples were first mechanically polished to remove surface impurities, including the oxide layer, and create artificial surface defects and micro-grooves. Mechanical polishing can provide a high degree of control over the length scale of the roughness features, for example, when silicon carbide (SiC) abrasive papers of known grits are employed. SiC has a hexagonal-rhombohedral crystal structure that was found to be excellent at imparting the desired three-dimensional features with a high degree of repeatability and consistency. A force of ~25 N per sample was employed in this study, and grits 60, 100, 150, 220, 320, 400, 600, and 1200 were used, for which the median particle diameters varied from 250 μm (60 grit) to 2.5 μm (1200 grit). The purity of copper used in this study was 99.99% (UNS#C10100, i.e. Alloy 101 Oxygen-free Copper). De-ionized water was continuously sprayed while polishing the samples to wash off the free copper particles that would otherwise fill the generated micro-grooves. The grooves typically have a diameter of that of the grit, from approximately 1 micron to approximately 500 microns. The mechanically polished copper pieces were thoroughly washed using 99.5% pure solutions of ethanol, acetone and isopropyl alcohol in a sequence followed by rinsing in running de-ionized water. The samples were dried using a clean paper towel subsequent to washing with each of the chemicals to remove the remaining copper particles, if any, on the surface.

Step 2: Thermo-Catalytic Etching

A suitable etching mixture was selected in this step by considering its ability to etch copper using the standard half-cell reduction potentials (E), and the chemical equilibrium constant ($K_{eq}$).

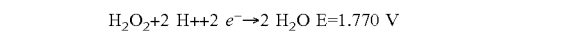

$$H_2O_2+2\ H^++2\ e^-\rightarrow 2\ H_2O\ E=1.770\ V$$

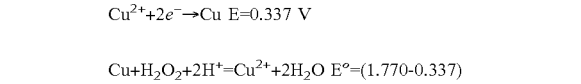

$$Cu^{2+}+2e^-\rightarrow Cu\ E=0.337\ V$$

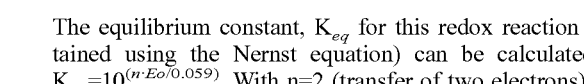

$$Cu+H_2O_2+2H^+=Cu^{2+}+2H_2O\ E^o=(1.770-0.337)\ V=1.433\ V$$

The equilibrium constant, $K_{eq}$ for this redox reaction (obtained using the Nernst equation) can be calculated as $K_{eq}=10^{(n\cdot Eo/0.059)}$. With n=2 (transfer of two electrons) and $E^o=1.433$ V, $K_{eq}=10^{48.58}$ indicating the strong ability of the hydrogen peroxide solution to etch copper. (For $K_{eq}>10^3$, the chemical reaction strongly favors the formation of products).

A solution of 3:3:2 by volume of ethanol (99.5%), de-ionized water and hydrogen peroxide (30% wt. in water) was used to etch the copper samples prepared in Step 1. The samples in the solution were heated in an oven for 90 minutes at 100° C. Since copper is usually non-reactive in dry air at room temperature, a high temperature environment was employed for promoting and catalyzing the etching reaction.

Step 3: Temperature Gradation Etching

The samples taken out of the oven were retained in the same etching solution for 12 hours to cause etching under a continuously decreasing temperature environment. All the samples were thoroughly washed with de-ionized water and dried in an oven for 15 minutes at temperatures above the boiling point of water at 1 atm. (a temperature of −110° C. was mostly used). The drying time was chosen so as to be sufficient to evaporate all the water, but not so long as to result in surface oxidation.

Results

Of the many different methods to calculate contact angle, the circle fitting method is one of the most widely used methods due to its simplicity and high accuracy. The method uses the complete drop shape for measurement of the contact angle. It assumes the shape of the droplet formed on a solid surface as a part of a sphere (or circle in a two-dimensional viewing plane). The method is prescribed for droplets with volume between 1 μL and 5 μL; accordingly, the effect of body forces such as gravity can be neglected in comparison to the surface tension of the droplet. In the present experiments a high resolution image of the droplet was captured using a 16 megapixel camera with the horizontal planes of the lens and the copper surfaces aligned in a straight line using a laser. The drop shape profile and the base line were realized using edge detection and image segmentation. A circle was curve-fitted to the drop shape profile which enabled finding the equation of the circle. The contact angle was then calculated based on the fitted circle equation and the detected base line.

TABLE 2

| SiC Paper Grit | 60 | 100 | 150 | 220 | 320 | 400 | 600 | 1200 | 2000 |
|---|---|---|---|---|---|---|---|---|---|
| CA | ~24° | ~18° | ~17° | ~19° | ~16° | ~14° | ~15° | ~18° | ~19° |

Table 2 shows the effect of sand paper roughness on the measured CA for 5 μL water droplets on the treated copper samples after step 2. It was found that the CA decreases as the grit (i.e., the smoothness of the sand paper) increases until a grit value of 400, after which an opposite trend is exhibited. In general, the contact angle values were found to arbitrarily depend on the sand paper roughness; however, all of the surfaces were found to have low CAs (less than 20° in most of the cases). In addition to the relatively safe nature of the approach, the employed mechanical polishing approach in Step 1 was found to provide a reasonably high degree of control and repeatability. Further, it was found to provide tremendous scope for promoting preferential etching along the grain boundaries by increasing the size and number of crystal imperfections.

Remarkably, as shown in FIG. 1, the samples after carrying out additional step 3 were found to behave as a paper towel in that they exhibited highly rapid absorption and spreading rates of water and other liquids on their surfaces. As shown in FIG. 2, the surfaces were found to behave in a similar fashion for many liquids, including glycerol, common refrigerants such as R-134a, dielectric liquids such as FC-770 and PF-5060, mineral oil and olive oil, and high viscous liquids such as SAE 10 and SAE 40. A well-defined and visible outline separate from the base line was not observed for droplets even with high-resolution images, implying that the CA was zero for most of the liquids and unmeasurably small even for liquids with high viscosity (such as SAE 40) indicating an ultra-polyphilic behavior for copper. Even though it is not practicable to test the wettability of the etched copper surfaces to practically every liquid, based on the surface topology observations reported in the subsequent section, it can be reasonably assumed that the procedure, in general, can be implemented to realize copper surfaces that would exhibit ultra-omniphilic behavior. High wetting with liquids of different surface tensions also suggests that wettability of the resultant surfaces is primarily dependent on roughness characteristics of the surface and not on the surface tension of the liquid, thus rendering the desired omniphilic (i.e. paper towel) characteristics.

Figure 3:
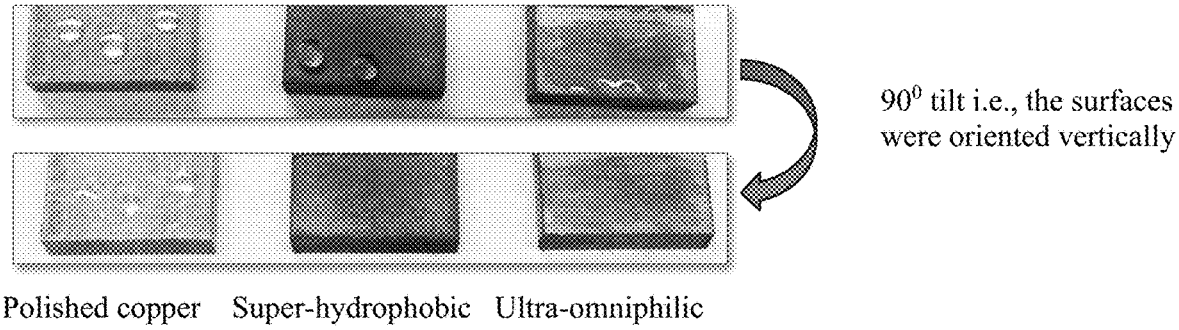
FIG. 3 shows the liquid retention capability of the ultra-omniphilic surface compared with polished and super-hydrophobic copper surfaces.
Figure 4A:
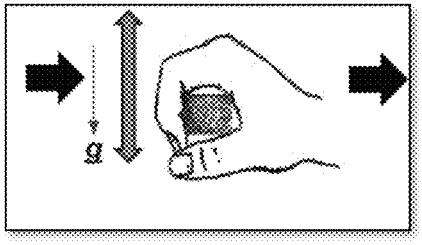
FIG. 4A is a schematic of the liquid retention capability shake test.
Figure 4B:
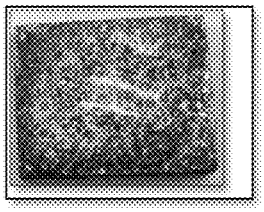
FIGS. 4B-4E show photographs demonstrating the results of the liquid retention capability shake test depicted in FIG. 4A.
Figure 4C:
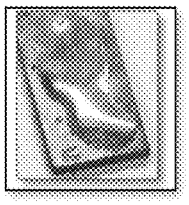
Figure 4D:
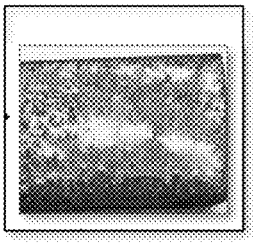
Figure 4E:
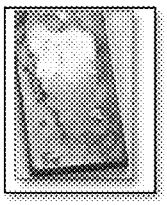

The wettability of the surfaces was quantified based on the liquid retention capability. For these tests, water was employed as the liquid. A 5 μL droplet (weighing ~0.005 g) was placed on the surfaces which were then subjected to repeated tilting (FIG. 3) and vigorous shaking (FIG. 4) tests. FIG. 3 shows the liquid retention capability of the ultra-omniphilic surface compared with polished and super-hydrophobic copper surfaces. Each surface with 5 μL water droplets was tilted by 90°. It was observed that droplets leave a residue on polished copper surface, while no trace of them was found on a hydrophobic surface. On the ultra-omniphilic surface, the excess water was found to drip while water absorbed by the surface remained as it is in the entire wetting area. FIG. 4A shows a 15×6 $cm^2$ ultra-omniphilic copper sample excessively saturated with water. FIG. 4B shows al 9×4 $cm^2$ ultra-omniphilic copper sample wetted with mineral oil. FIGS. 4C and 4D respectively show those surfaces after being subjected to vigorous vibration in the vertical direction. After vigorous shaking, both the liquids were retained in the ultra-omniphilic surfaces due to the strong capillary forces. The inertial forces generated by vigorous vibration were able to only drain the excess liquids in both the cases. In these tests etched copper surfaces showed a superior water retention capability compared to polished copper surfaces, which was evident from the weight of the remaining water held by the surface. With excess water shaken off the surface, the etched copper showed up to six times more retention capability on an average (0.003 g vs. 0.0005 g for untreated surfaces). In all the tests, weight of all the copper samples was measured initially and was subtracted from the total weight to obtain the weight of water retained. A high precision weighing balance was employed for this tests and it was calibrated to obtain an accuracy of +/−0.0001 g.

Figure 5A:
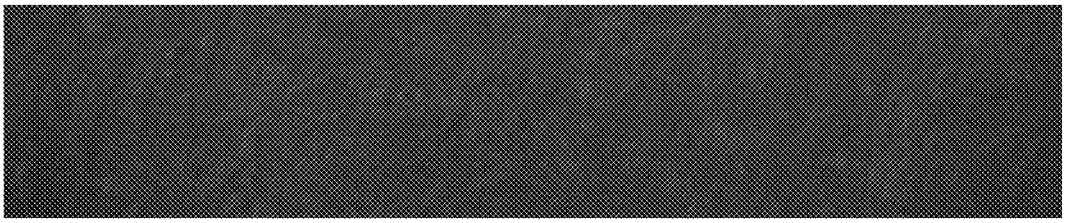
FIGS. 5A-5B show the results of mineral oil being pumped multiple times through a channel with water-wetted omniphilic walls. 1% Safranin O Stain® (or basic red 2) was added to water and the channel walls were observed under fluorescent microscope (Leica M165) before (FIG. 5A) and after (FIG. 5B) the flow experiments. Preservation of the red color on the entire wall surface indicated excellent liquid retention capability of the omniphilic surfaces under the condition of another liquid flowing over it.
Figure 5B:
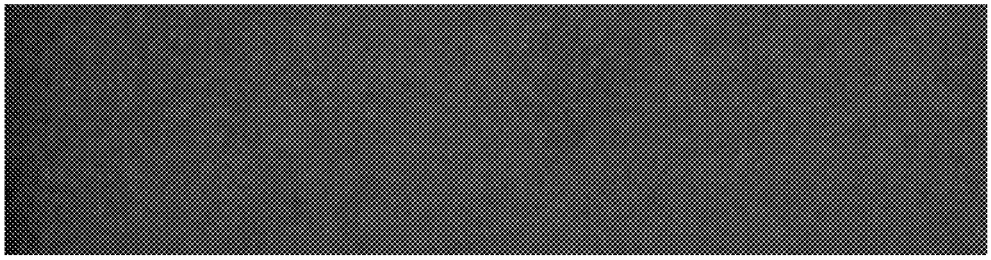

The ability of the ultra-omniphilic surfaces to strongly hold the wetting liquid was also tested under bulk liquid flow conditions. For these experiments, a channel of size 2.2 mm wide, 10 mm high and 50 mm long was used. Ultra-omniphilic copper walls of the channel were wetted with water mixed with Safranin O (basic red 2) at a concentration of 0.1 mg/mL. Mineral oil was then pumped as bulk liquid using a syringe pump at a flow rate of 140 mL/min for more than ten times. Leica M165 fluorescent microscope was used to observe the robust wetting characteristics of the ultra-omniphilic surfaces. FIG. 5 shows 800 ms exposure time fluorescence microscopy images obtained before (FIG. 5A) and after (FIG. 5B) pumping mineral oil. The preservation of red color confirmed the presence of infiltrated water layer on the surfaces. The collected mineral oil was examined under the microscope and no traces of Safranin O were observed.

Figure 6A:
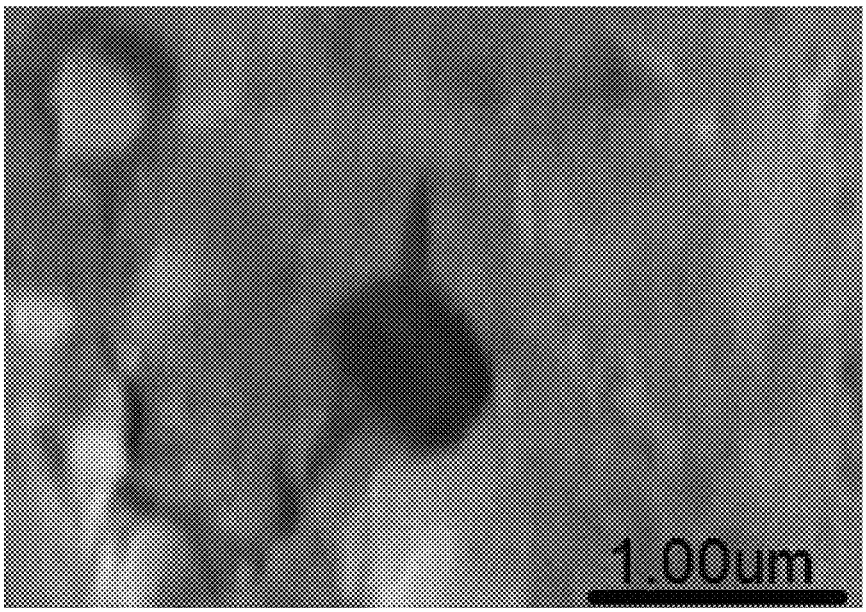
FIGS. 6A-6D show SEM micrographs of an ultra-omniphilic copper surface.
Figure 6B:
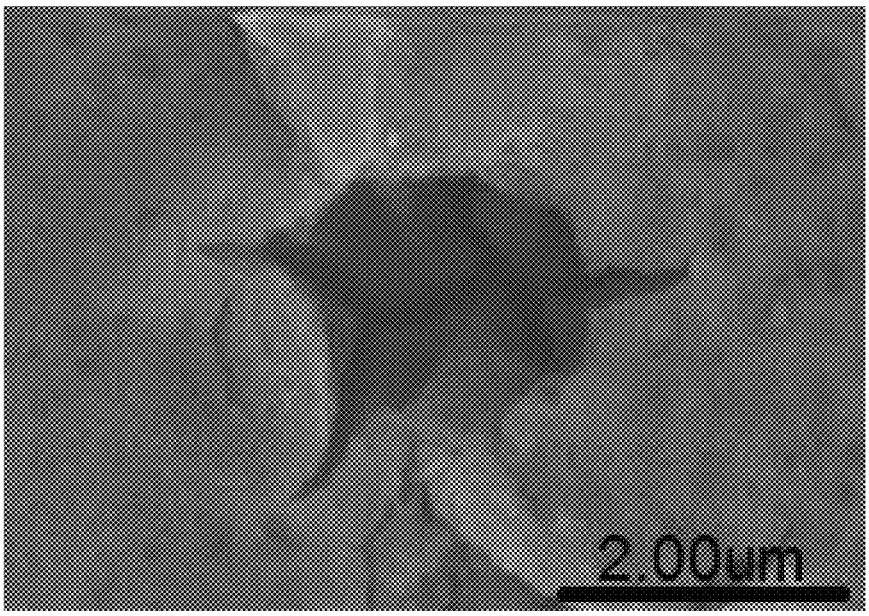
Figure 6C:
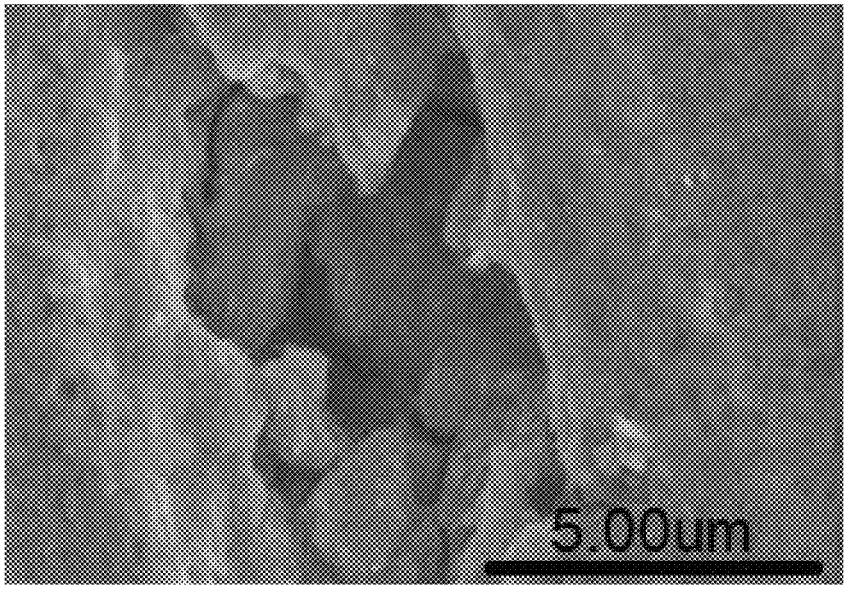
Figure 6D:
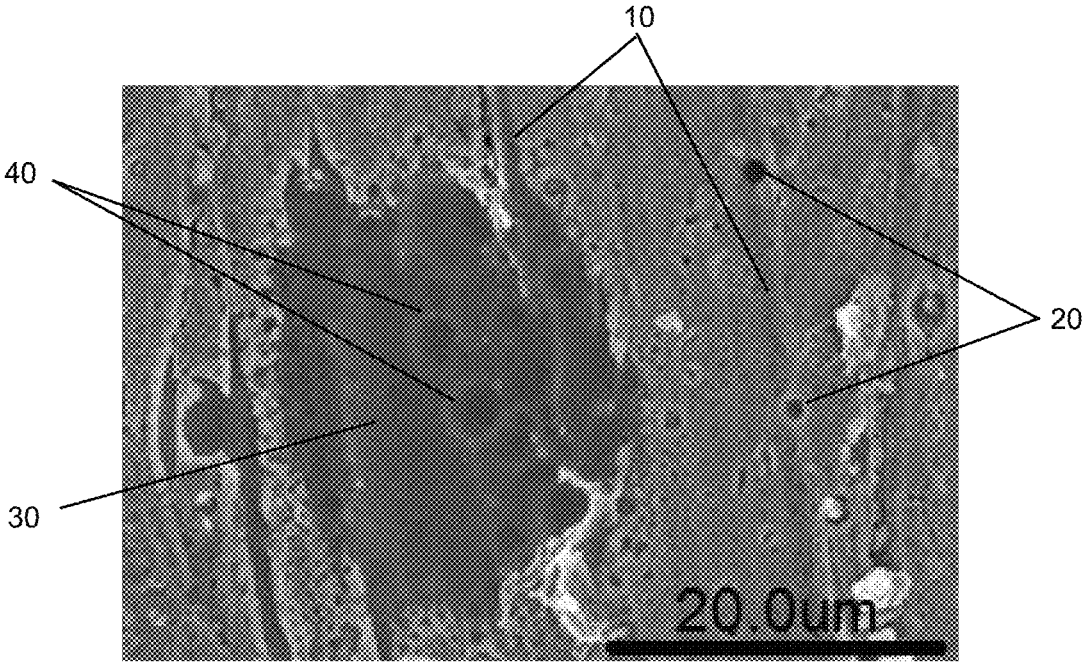

The surface features of the etched copper samples after Step 2 were observed under a scanning electron microscope (SEM) and the images are shown in FIGS. 6A-6B. All SEM images are from the same copper sample wherein pore sizes ranging from nano- to micro-scale were observed with micro-cavities having multiple nano-cavities inside. FIG. 6A was taken at a magnification of 37000×, and shows a pore diameter of about 600-700 nm. FIG. 6B was taken at a magnification of 10000×. The surface features of the etched copper samples after Step 3 were observed under a scanning electron microscope (SEM) and the images are shown in FIGS. 6C-6D. FIG. 6C was taken at a magnification of 5000×, and shows a pore diameter of about 4.5-5.5 μm. FIG. 6D was taken at a magnification of 2500×, and shows a micro-pore diameter of about 24-30 μm. The micrographs show that the nano-cavities formed after Step 2 have increased after performing Step 3 to micropore size, with additional nano-cavities being created within the micro-cavities. It can be observed that mechanical polishing magnifies crystal imperfections and creates artificial surface defects which directly help during Step 2 for promoting preferred and substantial etching along the grain boundaries of the otherwise unreactive copper. Different wetting behavior for different surfaces and also for different roughening times was observed, which also shows that there is no unique grit or polishing time to achieve an optimum roughness. Rather, these parameters can be vague with a definitive goal of creating new and/or magnifying existing crystal imperfections (which also depends on the original sample). It can be seen that the cracks developed on the surface after Step 2 are magnified into micro-cavities with nano-cavities inside them, resulting in a surface with hierarchical roughness.

Figures 7A, 7B, 7C:
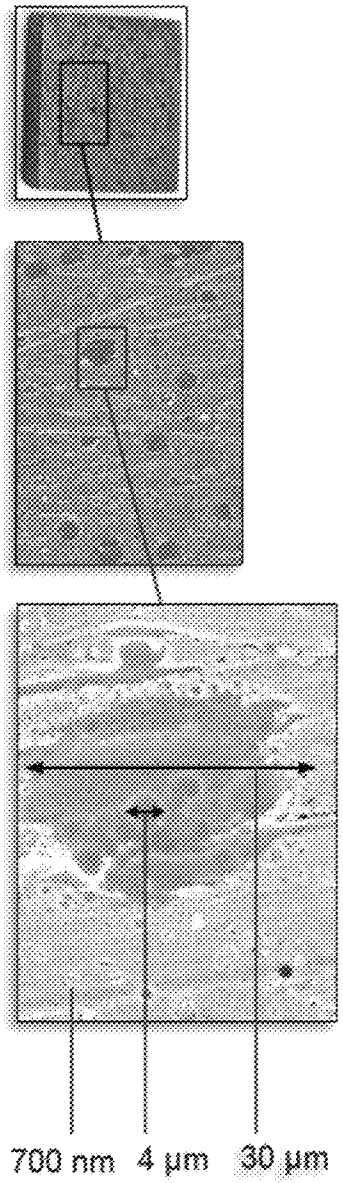
FIGS. 7A-7C are pictures showing hierarchical micro/nanoporous copper surfaces.

FIGS. 7A-7C are pictures showing the copper surfaces with a hierarchical micro/nano-roughness after carrying out Step 3. FIG. 7A was taken with a stereoscopic microscope at 10×; FIG. 7B was taken with a scanning electron microscope (SEM) at 500×; and FIG. 7C was taken with an SEM at 2500×. The size of the cavities ranged from a few nanometers up to a few tens of micrometers spanning a very wide and size range. The ultra-omniphilicity of the surfaces can be attributed to this roughness hierarchy which is believed to provide a very strong capillary action to most liquids. The treated surfaces were also found to have a connectivity of the micro/nano-cavities through the micro-grooves resulting from mechanical polishing, which is predicted to enable massively parallel wicking and spreading of liquids. Except for surfaces with added sintered particles or electrodeposited wires, none of the previously reported pure as-is copper surfaces disclose a dual length-scale roughness with a CA of zero. The observed roughness topology generated by implementing the present invention comprises a tremendous increase in the local contact area. The holding effect between the surface and the liquid on these ultra-omniphilic surfaces is also expected to provide excellent heat transfer characteristics, especially in applications such as cooling of electronics, refrigeration heat exchangers, heat pipes and vapor chambers that employ liquid-vapor phase change, and the application of liquid based thermal interface materials to heat sinks in electronics packaging solutions. The ultra-omniphilic surface of the present invention may also have a low Kapitza resistance due to an enhanced liquid-solid interaction energy flux, especially when compared to hydrophobic surfaces. A decreased Kapitza resistance on ultra-omniphilic surfaces would make them suitable for applications specifically involving high heat flux dissipation.

The size of the micro-cavities formed on the surface was found to depend on the orientation of the copper samples in Steps 2 and 3. Horizontal orientation of the surfaces to be etched was observed to provide slightly larger cavities (i.e., with more material removal) when compared to other orientations. This can be attributed to the buoyancy-dependent bubble departure mechanism during etching with the peroxide solution that favors horizontal orientation.

From the surface analysis of the ultra-omniphilic surfaces, the Wenzel model can be used to analyze the extreme spreading behavior of liquid droplets. The Wenzel model describes the homogeneous wetting regime using the equation $\cos\theta^* = r\cdot\cos\theta$, where $\theta^*$ is the apparent contact angle on a roughened surface corresponding to the minimum free energy state for the system, r is the roughness ratio (which is the ratio of total area of a rough surface to the apparent or projected area), and $\theta$ is the contact angle made by a liquid droplet as measured on the smooth solid surface. If the present etching approach is assumed to be isotropic, the value of r for any hemispherical embryo will be 2. But with a $\theta^*$ of zero for water on ultra-omniphilic surfaces and a $\theta$ of 70-80° for water on smooth copper, it can be obtained from the Wenzel equation that r for the ultra-omniphilic surfaces is at least 2.92 and possibly larger than 5.76. These r values show a substantial increase in the surface area at micro/nanoscale, which could be primarily attributed to the presence of numerous nano-cavities within the micro-pores and the massively parallel connectivity of the cavities through micro/nano-grooves obtained by the mechanical polishing of Step 1. Such grooves can be seen in FIG. 7. Micro/nano-scale surface area enhancements of this magnitude may play a very significant role in applications such as heat transfer with phase change.

The surface analysis can also be used to discuss the droplet spreading dynamics. The balance of viscous force and surface tension force on a droplet can be used to analytically determine the spreading radius at any instant, $R_{sp}$, on a smooth surface. From the analytical solution, $R_{sp} \propto (1/Ca)^{1/12}$, where Ca is the capillary number, which is the ratio of viscous force to the surface tension. For $Ca \ll 1$, interfacial forces dominate viscous force (favors spreading) while for $Ca \gg 1$, viscous force dominates interfacial forces.

For ultra-omniphilic surfaces, with an r value larger than 2.92, capillary forces dominate the viscous forces more than on a smooth surface. This decreased Ca explains the reason for the spreading of droplets to a larger radius on an ultra-omniphilic copper surface compared to a smooth copper surface.

Figure 8A:
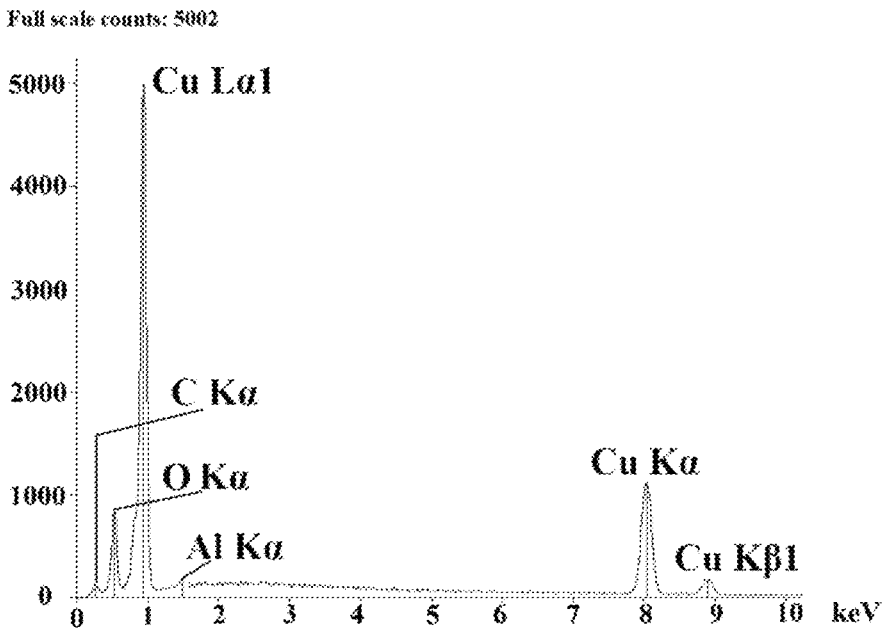
FIGS. 8A and 8B show elemental analyses of copper surfaces prepared in accordance with an embodiment of the present invention when exposed to ambient conditions and when remaining unexposed, respectively.
Figure 8B:
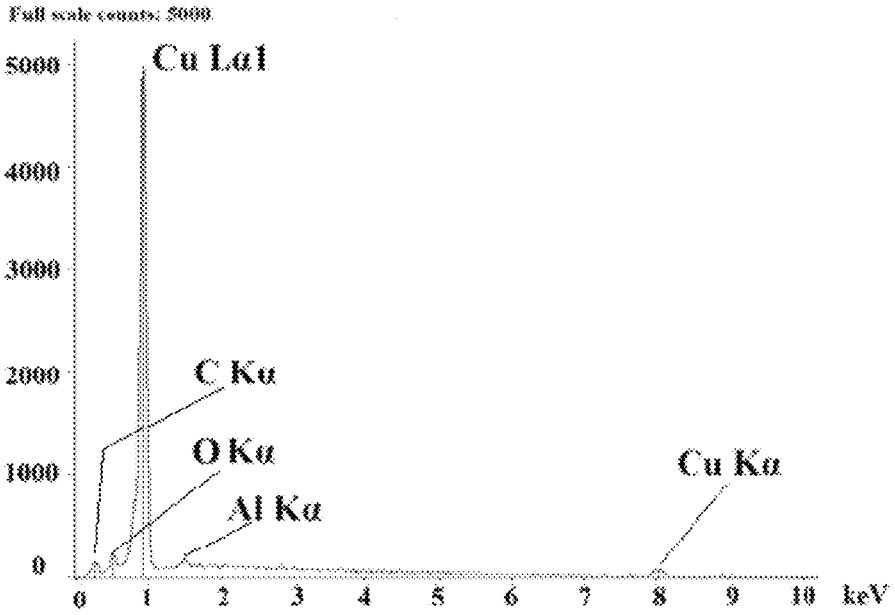

According to the measured SEM spectral elemental analysis of the surface, the surface was found prone to oxidation in open environments as expected. As shown in FIG. 8A this was indicated by four peaks distinctive of oxygen (Kα), copper (Lα1), copper (Kα) and copper (Kβ1) which appeared after Step 3. The oxygen percentage on all the copper sample surfaces was found to be less than 11.8% while it was found to be less than 5% for unexposed sample surfaces, as shown in FIG. 8B. In the plots, the source of oxygen (O) is expected to be CuO (from surface oxidation) while the -primary source of carbon (C) is expected to be the sand paper (SiC). The element analysis shows that the ultra-omniphilic behavior of the resulting samples is due to the porous structure on copper but not due to the presence of a -philic element on the surface. The analysis also establishes the non-toxic nature of the resulting ultra-omniphilic surfaces with only copper as the element (possible under more controlled conditions of polishing, cleaning and oxidation).

Figure 9A:
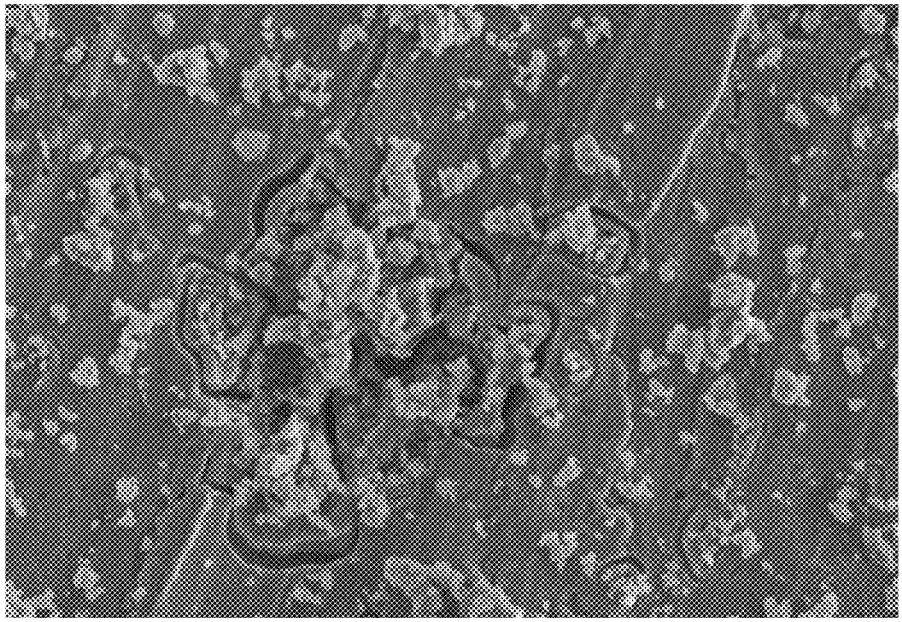
FIGS. 9A and 9B show SEM micrographs taken at different magnifications showing surface oxidation on treated samples after exposing them to ambient conditions for 192 hours.
Figure 9B:
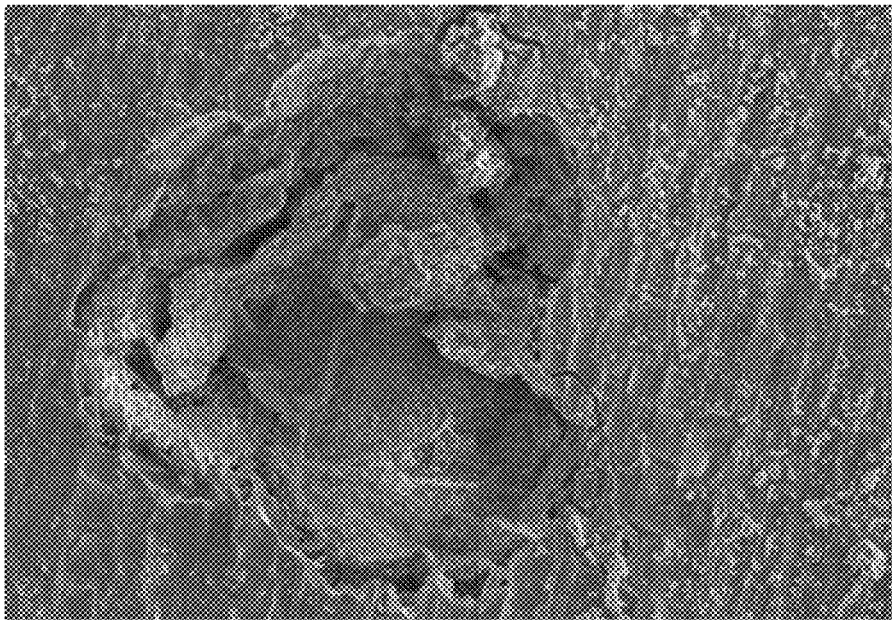

The samples were tested for omniphilicity after surface oxidation; i.e., after exposing them to ambient for 192 hours. It was found that an oxide layer forms inside the cavities, thus blocking them and reducing the omniphilic property of the surface. FIGS. 9A and 9B show SEM micrographs taken at the magnifications of 2500× and 5000×, respectively, showing surface oxidation on treated samples after exposing them to ambient conditions for 192 hours. The resultant CuO was found to fill the cavities at both micro- and nano-length scales affecting the -philicity property of the surface.

Newly prepared samples were also placed in a liquid bath for 16 weeks. After removing the samples from the bath and drying them in an oven, the surfaces were found to exhibit their ultra-omniphilic characteristics without any performance degradation, showing the robustness and suitability of these surfaces for use in closed environments (such as in channel and pipe flows). In applications requiring surface exposure, thin anti-oxidative coatings could be selectively deposited on the surface without blocking the micro/nano-cavities.

Hydrophobic Copper Surfaces

For preparing super-hydrophobic copper surfaces, an additional processing step was employed, in which the same samples obtained after processing Step 3 were immersed in a solution of 0.5% wt. stearic acid and ethanol, and vigorously shaken in an ultrasonic machine for 40 minutes. This ensured a homogeneous distribution of the non-polar solute on the surface, and hence a thin uniform coating of the ester on the samples. The samples were then dried in an oven at 50° C. for 60 minutes.

Figure 10A:
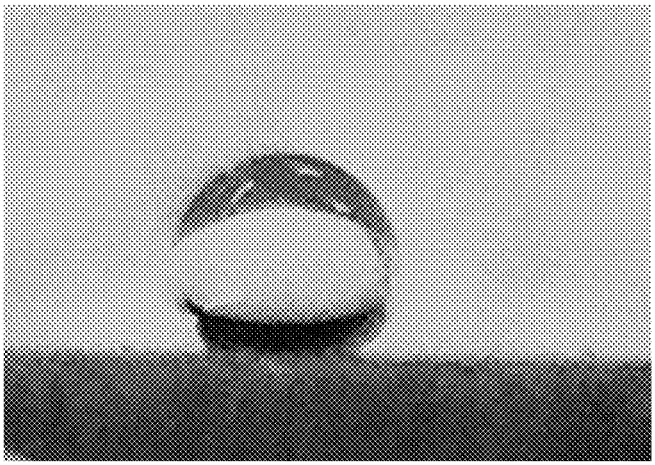
FIGS. 10A-10C show photographs of 3 mL water droplets on hydrophobic copper surfaces.
Figure 10B:
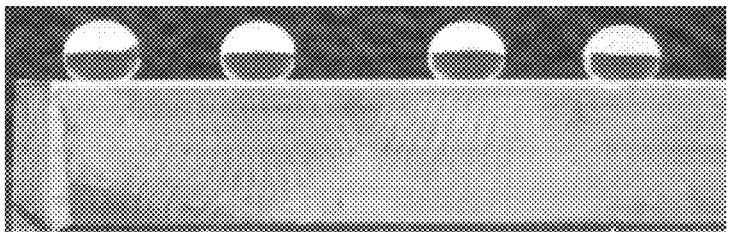
Figure 10C:
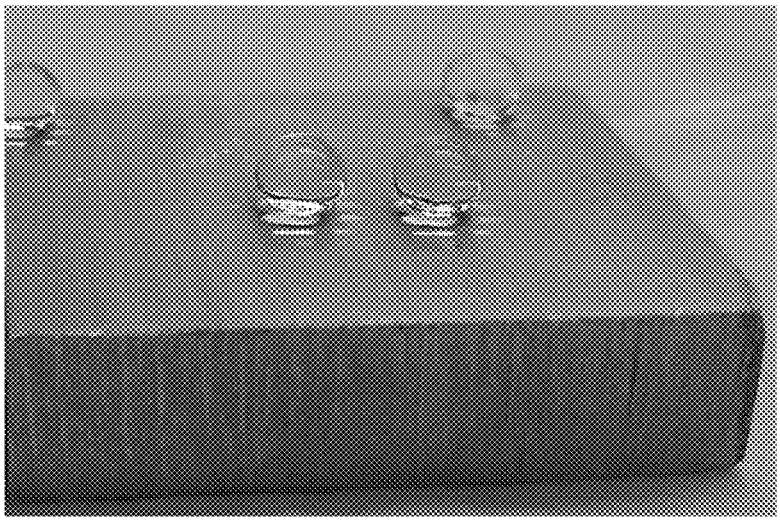

After carrying out Step 4 the surfaces were found to be hydrophobic, with a measured CA between 127° and 152° depending on the roughness of the omniphilic surface. FIG. 10 shows hydrophobic copper surfaces. FIG. 10A is a photograph showing a 3 mL water droplet on the copper hydrophobic surface. FIG. 10B is a side view of the hydrophobic surface sample with 3 mL water droplets. FIG. 10C is a top view of 3 mL water droplets on the hydrophobic surface sample exhibiting the lotus leaf effect (i.e., droplets do not stick to the surface and have a tendency to roll). Further, the non-polar coating ensured negligible surface oxidation and formed a monolayer of ester that is adsorbed on the copper surface. While the adsorption was found to be physical with the hydrophobic groups pointing outwards, addition of heat to copper in the stearic acid-ethanol solution in Step 4 was found to result in a chemical adsorption of ethyl stearate on the surface. Increasing the concentration of stearic acid in Step 4 was found to form copper stearate on the surface (visually identified by its aqua blue color). The resultant surfaces with the ester monolayer were subjected to high fluid pressures (up to 10,000 $N/m^2$) and no degradation of the adsorbed coating was observed (as confirmed by repeated CA measurements). This robustness can be attributed to the hierarchical porosity of the surfaces that provides a strong trapping/holding capability to air in the adsorbed coating of the ester.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. A hydrophilic surface of a metal or alloy, the surface comprising:
- a plurality of grooves;
- a plurality of micro-cavities randomly distributed on the surface; and
- a plurality of nano-cavities randomly distributed on the surface.

2. The surface of claim 1 which does not comprise protrusions, a coating, or an oxide.

3. The surface of claim 1 which is superhydrophilic, polyphilic, omniphilic or ultra-omniphilic.

4. The surface of claim 1 which has the same composition as the bulk metal or alloy.

5. The surface of claim 1 wherein said grooves each comprise a width of between 1 micron and 1000 microns.

6. The surface of claim 1 wherein said micro-cavities comprise a diameter of between 1 micron and 500 microns.

7. The surface of claim 1 wherein said nano-cavities comprise a diameter of less than 1 micron.

8. The surface of claim 1 comprising a contact angle of zero.

9. The surface of claim 1 wherein at least some of the nano-cavities are disposed within a microcavity.

10. A hydrophobic surface of a metal or alloy, the surface comprising:
- a plurality of grooves;
- a plurality of micro-cavities randomly distributed on the surface;
- a plurality of nano-cavities randomly distributed on the surface; and
- an adsorbed ester layer.

11. The surface of claim 10 wherein said ester comprises a stearate.

12. The surface of claim 10 wherein at least some of the nano-cavities are disposed within a microcavity.

* * * * *